US006923136B1

(12) United States Patent
D'Alessandro

(10) Patent No.: US 6,923,136 B1
(45) Date of Patent: Aug. 2, 2005

(54) AUTOMATIC TRIM FOR POWER BOATS

(76) Inventor: David A. D'Alessandro, 210 North Rd., Clemons, NY (US) 12819

( * ) Notice: Subject to any disclaimer, the term of this patent is extended or adjusted under 35 U.S.C. 154(b) by 49 days.

(21) Appl. No.: 10/843,986

(22) Filed: May 12, 2004

Related U.S. Application Data

(63) Continuation-in-part of application No. 10/800,303, filed on Mar. 12, 2004, now abandoned, which is a continuation-in-part of application No. 10/370,965, filed on Feb. 20, 2003, now abandoned.

(51) Int. Cl.[7] ..... B63B 1/22

(52) U.S. Cl. ..... 114/285

(58) Field of Search ..... 114/285–287; 440/61 R, 61 T–61 J

(56) References Cited

U.S. PATENT DOCUMENTS 2,886,462 A * 5/1959 Jagiel ..... 248/617

* cited by examiner

*Primary Examiner*—Ed Swinehart
(74) *Attorney, Agent, or Firm*—M. P. Williams

(57) ABSTRACT

A trim tab (18, 204) hinged (19) at the bottom edge of a boat transom (12, 179) is rotated into a position below the boat when the drive (58, 186) is in a lowest-most trim position, and is raised up, when the drive is above a selected pickup trim position. A push tube (58) connected to the motor (16) operates a push rod (49) and a trim tab (18). A push bar (96, 97) is moved by the drive, causing pieces (104, 105) to rotate trim tabs (18*a*). A fluidic slave cylinder (142) is operated by a master cylinder (134) or by a pump (148) responding to a position detector (150). Levers (164, 167) may be connected by a cable (155). A hydraulic master cylinder (195) is disposed on a part (186) of an outdrive that rotates for trim, its cylinder rod (200) contacting a fixed part (184), driving fluid to a slave cylinder (201) mounted on a fixed part (183) with its piston rod (202) moving a trim tab (204).

16 Claims, 10 Drawing Sheets

AUTOMATIC TRIM FOR POWER BOATS

CROSS REFERENCE TO RELATED APPLICATIONS

This is a continuation-in-part of U.S. patent application Ser. No. 10/800,303, filed Mar. 12, 2004, now abandoned, which is in turn a continuation-in-part of U.S. patent application Ser. No. 10/370,965 filed on Feb. 20, 2003 now abandoned.

TECHNICAL FIELD

This invention relates to providing additional trim to a power boat at low speed, thereby to lift the stern and obtain plane more quickly, the trim being automatically effected by the power trim of the drive, such as the motor or outdrive.

BACKGROUND ART

It is well known that when a power boat accelerates from a standstill, the nose goes high and the stern goes low until a certain speed is obtained, which typically is between 20 and 30 miles per hour. Then the boat levels off and is said to be on plane. It is for this reason that transoms tilt so as to be closer to the bow below the water line, thereby to provide some upward thrust on the stern during initial acceleration. Modern bass boats and ski boats have power trim which allows the operator to tilt the propeller aft and upwardly once plane has been attained, thereby to keep the bow of the boat from plowing, and reduce drag, so that higher speeds may be attained and less effort of the motor is required to achieve any given speed. Trim tabs have been provided at the aftmost extreme of the hull, extending downwardly somewhat from the bottom of the hull. Static trim plates however remain in place at higher speeds and thereby produce significant drag, which reduces speed and wastes fuel. Adjustable trim tabs are complex and require electric or hydraulic mechanisms together with operator controls and communication between the mechanisms and the controls, and require operators to adjust more than one trim control as boat speed changes.

DISCLOSURE OF INVENTION

Objects of the invention include: providing low speed upward trim automatically in response to the position of the drive; trimming which is responsive to the power trim of the boat's drive; using the power trim of the boat drive to create additional trim providing lift to the stern of the boat at low speeds, and providing no drag at all at higher speeds.

According to the present invention, the stern of the boat is lifted during acceleration at very low speeds by means of at least one trim tab which is moved downwardly into a full lift position by the boat's drive when the drive is in the lowest trim position, and which is rapidly raised to a position where it is out of the water, thereby providing absolutely no drag, in response to a small amount of trim imparted to the boat's drive. By being coupled to the boat's drive, the stern-lifting trim tabs of the invention are automatically in place when desired, and out of the way when trim is not desired. The invention is readily adapted to a wide variety of inboard/outdrive and outboard boats and hulls.

According to the invention still further, one embodiment of the invention, useful with an outboard motor which is extended from the transom by a jack plate, has a push tube that provides free play of the engine at higher trim positions, but engages a push rod at lower trim positions, the push rod being connected with at least one trim tab so that as the motor reaches the lowest positions of trim, the push tube engages the push rod and causes the trim tab to be lowered into the water, below the fair line of the hull bottom.

According to the invention in another form, which is suitable for use with outboard motors mounted directly to a transom and with inboard/outdrive packages, a horizontal push bar pushes on linkage that operates the trim plate only when the boat's drive, that is the vertical portion of the power train that transfers torque to the propeller, is in the lowest trim positions. In the highest trim positions, free play is obtained because the drive does not engage the horizontal push bar.

Another embodiment of the invention includes a master cylinder engaged by the drive when the drive is reaching its lowest trim positions, the master cylinder being connected by tubing to one or more slave cylinders connected to at least one trim tab. Although hydraulic fluid is preferred, this embodiment may be pneumatic, if desired. The master cylinder may have a larger piston area and shorter stroke compared with the slave cylinder, which may have a longer stroke by virtue of a smaller piston area than the master, whereby to cause a very sharp deployment of the one or more trim tabs as a consequence of a very small change in trim. Or, the invention works quite well with master and slave cylinders which have equal areas and strokes. One particularly advantageous utilization of this embodiment of the invention is found in boats having internal engines connected to outdrives. The master cylinder is connected to the drive, which is trimmed up and down under operator control, having a pick up point where it contacts a non-rotating part of the outdrive, thereby compressing the fluid within the master cylinder, which is transferred to a slave cylinder mounted either on the transom of the boat or on a non-moving part of the outdrive, with its cylinder rod connected to the trim tab.

Yet another embodiment uses a position detector to provide an electrical signal indicative of the position of the drive, whenever the drive is sufficiently low so as to engage the trim tabs. The position signal is utilized to operate a pump which operates an hydraulic actuator to move the trim tab proportionately with the position of the drive. This embodiment may be practiced on boats already having hydraulic trim which is, however, manually controlled, by substituting a position sensor and other appropriate electronics for the manual controls.

In another embodiment, a power transmission cable, such as a throttle cable, is utilized with linkages to transmit the engine position mechanically to operate the trim tab, once it is at the point of engagement.

Although the first two embodiments find their greatest utilization in situations in which the drive does not achieve various vertical or horizontal positions with respect to the hull of the boat, the last mentioned three embodiments are useful in manually or hydraulically adjustable jack plates, and in other situations where position of the drive with respect to the boat (other than its trim position) may vary.

The invention may be implemented utilizing rack and pinions, jack screws, stepper motors, or other actuators to move the trim tab. The actuators may respond to a variety of drive position sensors, such as linear variable differential transformers (LVDTs), potentiometers, with rack and pinion or other gearing where appropriate, and in the simplest of cases, a switch which causes the trim tabs to be moved to the fully downward position as soon as the switch is engaged, and causes the trim tabs to remain in that position until the switch is released. This is achievable, for instance, utilizing fluidic pressure in a hydraulic or pneumatic cylinder connected to the trim tabs.

The invention obviously can be utilized with one trim tab or several trim tabs, with one or more actuators on each trim tab.

The invention provides significant stern lift at lowest speeds, but provides no drag at medium and upper drive trim positions, all of the motion of the trim tab being controlled by the boat's drive in response to the power trim already installed with the boat drive.

Other objects, features and advantages of the present invention will become more apparent in the light of the following detailed description of exemplary embodiments thereof, as illustrated in the accompanying drawing.

MODE(S) FOR CARRYING OUT THE INVENTION

Figure 1:
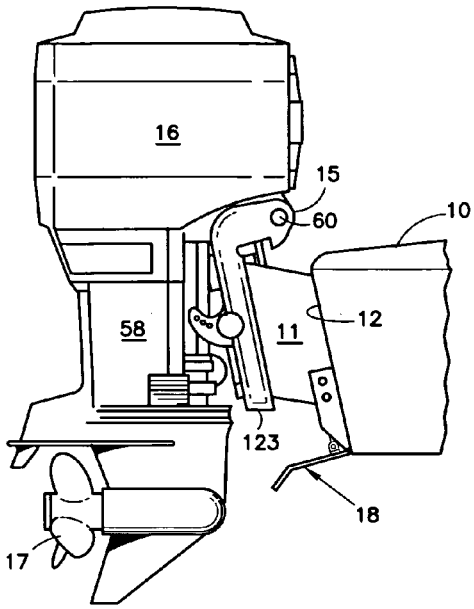
FIG. 1 is a side elevation view of an outboard motor mounted on a jack plate with one embodiment of the invention installed, when the drive and the trim tab are all the way down.

Referring to FIG. 1, a boat 10 has a jack plate 11 (or motor mount), mounted to the transom 12 of the boat. The transom bracket 15 of a propulsion system, such as an engine 16 is mounted to the jack plate 11, all in a known fashion. The engine has a propeller 17. A trim plate 18 is rotatably disposed at the base of the transom by means of a piano hinge or other suitable hinge (19, FIG. 5) so that the trim plate can rotate upwardly and downwardly in response to different trim positions of the motor 16, as illustrated in FIGS. 1–4.

In FIG. 1, the motor is in its lowermost, untrimmed position, and the trim plate 18 extends below the fair line of the hull. As the motor is trimmed a little bit, illustrated in FIG. 2, the trim plate 18 rotates upwardly to about a mid point. As the motor trim is increased, as illustrated in FIG. 3, the trim plate 18 rotates into a fully upward position, where it is out of the water and has absolutely no effect. As the trim of the motor is increased further, as illustrated in FIG. 4, due to a lost-motion effect described with respect to FIG. 5 hereinafter, the trim plate remains in its fully upward position, independently of further upward trim of the engine 16.

Figure 5:
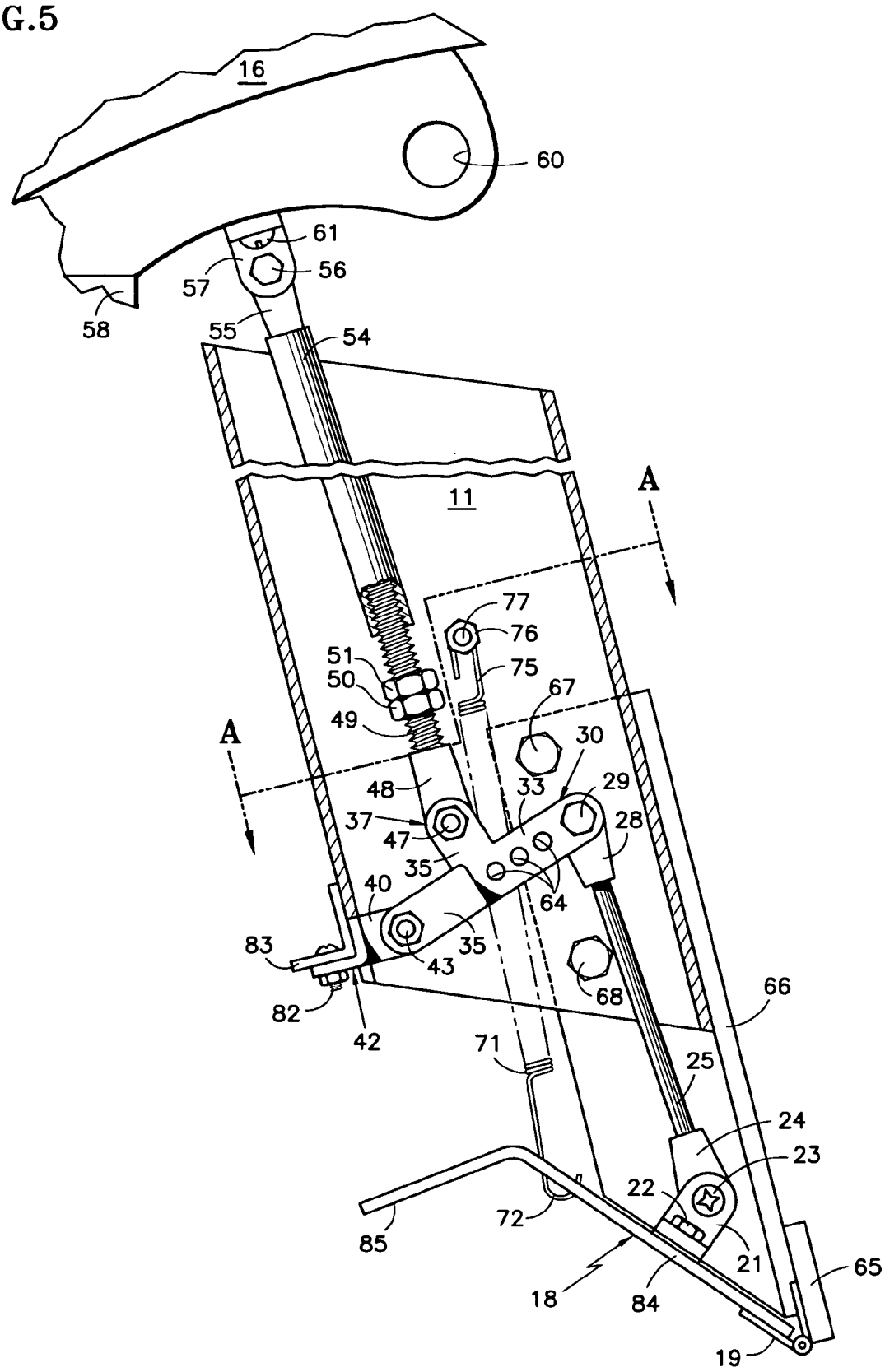
FIG. 5 is a partial, partially sectioned, side elevation taken on the line B—B in FIG. 6, with the trim plate in the position shown in FIG. 3.
Figure 6:
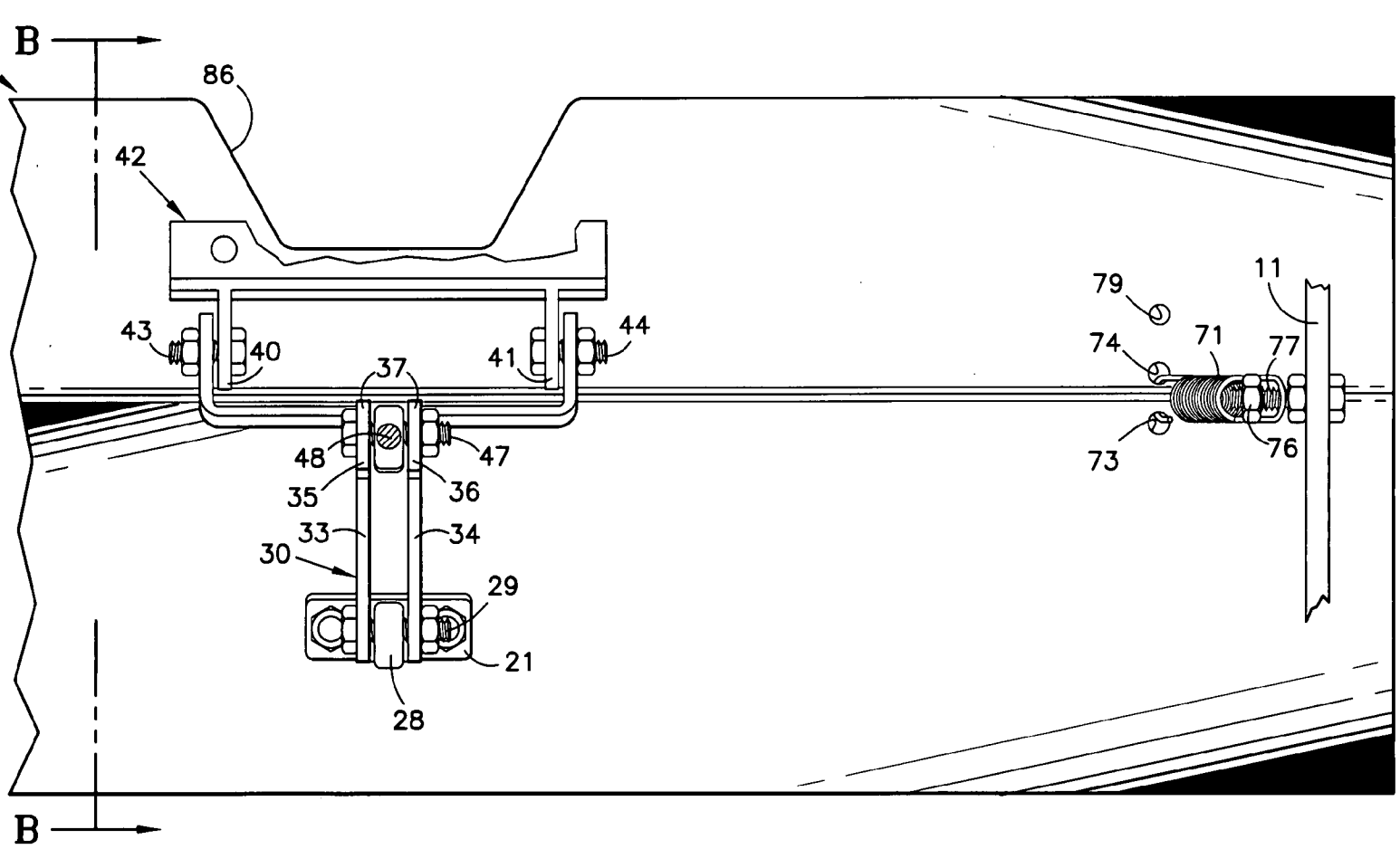
FIG. 6 is a partial, partially sectioned, top plan view taken on the line A—A of FIG. 5, with the template in the position shown in FIG. 2.

Referring to FIGS. 5 and 6, the trim plate 18 has a clevis 21 attached thereto by means of flat head machine screws (not shown) and nuts 22. A pintle bolt 23 rotatably secures a tongue 24 to which is threaded a rod 25. The rod 25 is also threaded into a tongue 28 which is pivoted by a pintle bolt 29 to a clevis 30. As seen in FIG. 6, the clevis 30 is formed of two pieces 33, 34 which have upwardly extending tabs 35, 36 that form another clevis 37. The pieces 35, 36 are bolted to corresponding tabs 40, 41 of a bracket 42 by bolts 43, 44. The pieces 33, 34 are free to rotate upwardly and downwardly about the bolts 43, 44. A pintle bolt 47 secures a tongue 48 into which is fixed a threaded push rod 49 having a pair of nuts 50, 51 tightened thereon. The push rod 49 is surrounded at its upper end by a push tube 54 which is free to slide up and down on the push rod 49, above the nut 51. The push tube 54 is fastened to a tongue 55 that is engaged by a pintle bolt 56 within a clevis 57 which is anchored to the engine drive 58, just aft of the tilt tube 60, by means such as machine screws 61.

Figure 2:
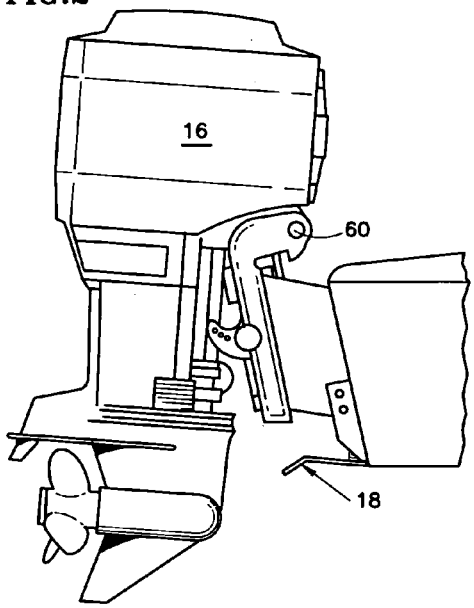
FIG. 2 is a view as in FIG. 1 with the drive and the trim tab partially up.
Figure 3:
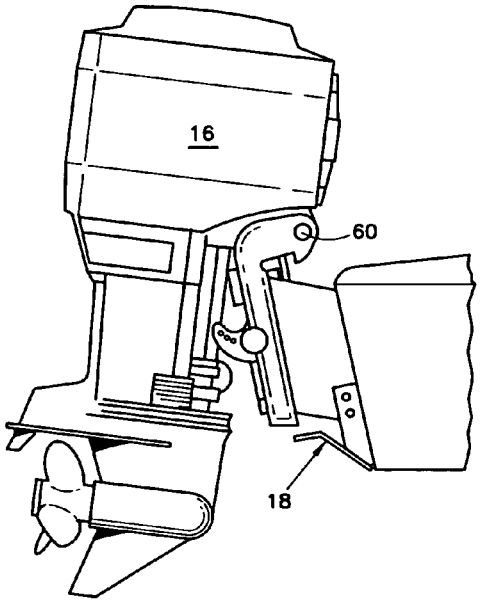
FIG. 3 is a view as in FIG. 2 with the trim tab fully up and the drive at about a mid-trim position.
Figure 4:
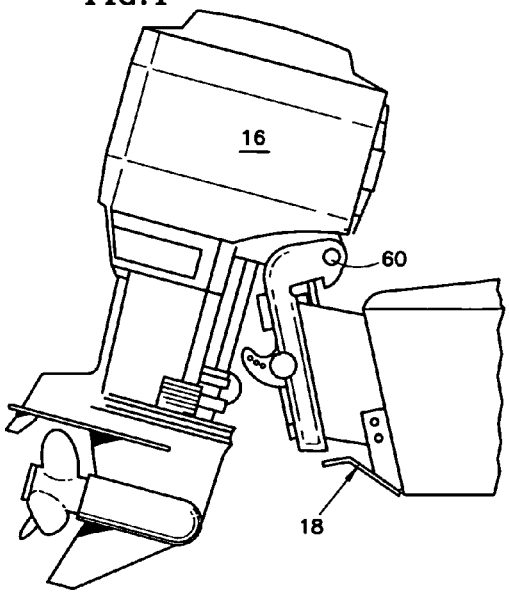
FIG. 4 is a view as in FIG. 1 with the trim tab fully up and the drive in nearly the full trim position.

As the motor is trimmed in the various positions shown in FIGS. 2–4, the push tube 54 will be raised and lowered commensurately. So long as the motor has sufficient trim that the tilt tube does not touch the top of the nut 51, the trim plate 18 will be unaffected. But when the trim is lowered sufficiently, the push tube reaches the pick up point which is when it contacts the top of the nut 51, beginning to rotate the clevis 30 downwardly, thereby pushing downwardly on the trim plate through the rod 25.

The pick-up point (the point at which the trim plate 18 will begin to be lowered) is determined by the setting of the nuts 51, 50; if the nuts are higher, the engagement is at a higher trim position, and if the nuts are lower, the engagement is at a lower trim position. The lengths of the push tube 54 and push rod 49 should be sufficient so as to not disengage by virtue of the trim tab rising, when the boat is backing up with the motor trim down, due to force of water against the trim tab.

The amount of trim tab motion, or the trim tab position, as a function of motor motion, or motor position, can be adjusted by placement of the pintle bolt 29 in different positions established by a plurality of holes 64 in the pieces 33, 34. As shown in FIGS. 5 and 6, a relatively small amount of engine motion will provide the full range of trim tab motion. In FIG. 5, the hinge 19 is shown as it may be connected to a cross strap 65 which may be part of a jack plate, or which may be added to the standard jack plate structure. In this case, the cross plate 65 is fastened, such as by machine screws (not shown) to a bracket 66 that is bolted to the jack plate 11 by means of bolts 67, 68. The use of the bracket 66 allows positioning the trim tab 18 at the very base of the transom, well below the extent of a typical jack plate.

The upper position of the trim tab 18 is defined by the bottom of the bracket 66, as shown in FIG. 5. The trim plate 18 is urged upwardly by means of a spring 71, the lower loop 72 of which extends between a pair of holes 73, 74 (FIG. 6).

An upper loop 75 of the spring 71 is secured by a lock nut 76 on a bolt 77 which extends through the far wall of the jack plate 11. Additional holes, such as a hole 79 (FIG. 6) may be provided to allow adjustment of the spring tension, and the direction of force provided by the spring.

In FIGS. 5 and 6, the jack plate is simulated and does not represent any particular known jack plate. The bracket 42 is shown fastened, such as by a machine screw and nut 82 to an angle iron 83 (not shown in FIG. 6 for clarity) which may extend across the jack plate. However, the bracket 42 may, in a typical case, be fastened directly to some part of the engine itself, such as the zinc plate, or other structure on the drive.

The trim tab 18 is shown to have a proximal portion 84 which is connected to the hinge 19 and a distal portion 85 which is at an angle to the proximal portion 84. On the other hand, the trim tab 18 may be rounded instead of having a distinct angle, or it may simply be a straight piece. The shape of the trim tab is irrelevant to the present invention, so long as it can be moved from a position providing significant lift to a position where it has no effect whatsoever in an adequately small range of motor trim adjustment. Although only the spring 71 is shown on the port side of the boat, a similar spring may be similarly disposed on the starboard side of the boat. In FIG. 6, the trim tab 18 is shown with a notch 86 in the aft edge thereof, which might be useful in some installations to provide adequate clearance to the fairwater of the lower drive of the engine. On the other hand, no notch 86 need be provided if not useful in any given case.

Two separate trim tabs may be controlled by separate rods 25 if the pintle nut is extended to opposite sides of the drive, or by separate rods 25 and devises 30 by extending the pintle bolt 47 to opposite sides of the drive. If the push tube 54 is otherwise guided and/or supported, the pintle bolt 56 and clevis 57 may be omitted.

The embodiment of the present invention described with respect to FIGS. 1–6 is disposed within the space provided by a jack plate. The typical jack plate has a fore-and-aft dimension of at least a few inches within which the apparatus of FIGS. 5 and 6 can easily be disposed. A jack plate also provides space for the trim tab between the lowest part of the transom and the engine, as is seen in FIG. 5.

Figure 7:
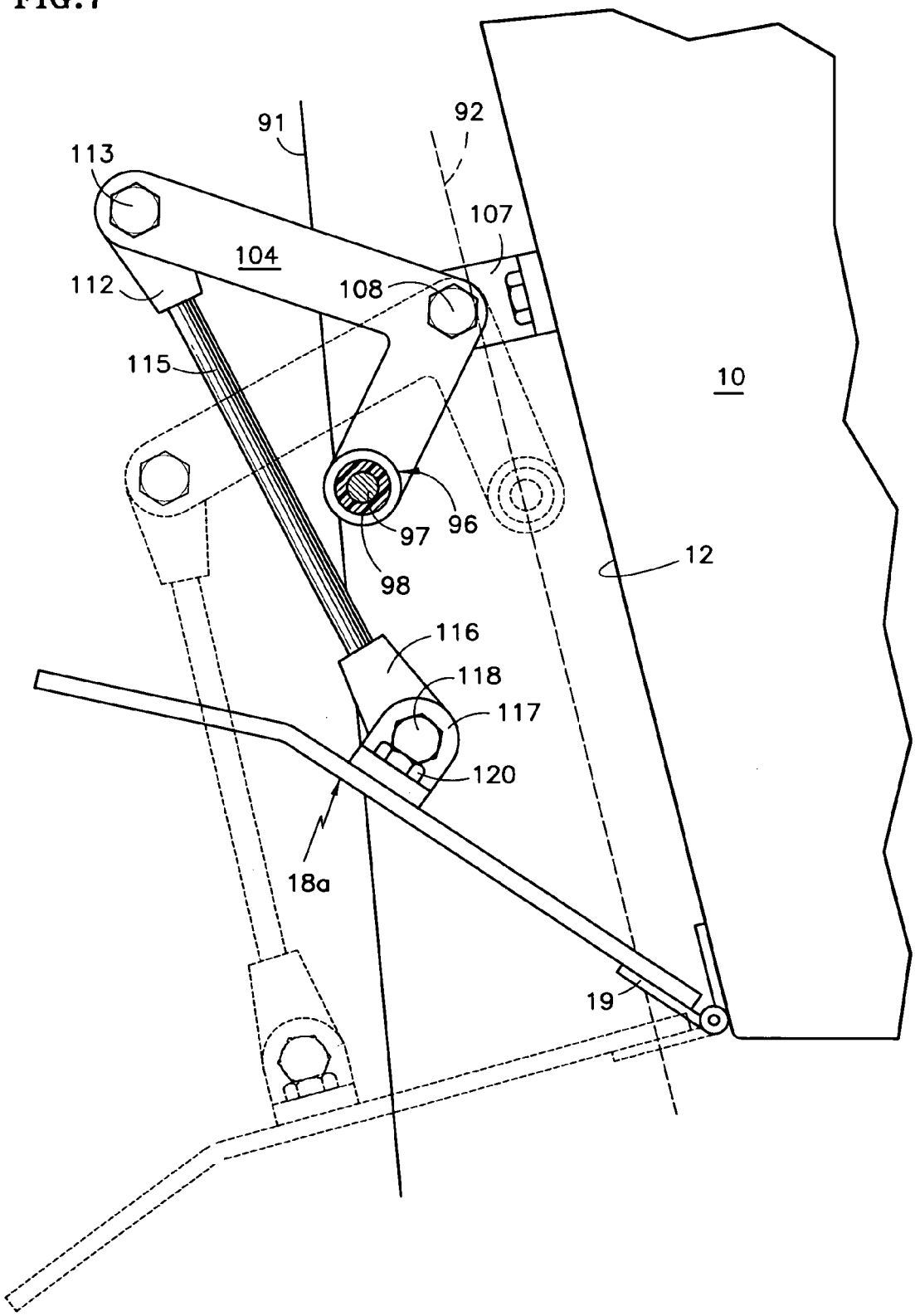
FIG. 7 is a side elevation view of an alternative embodiment of the invention, using a push rod.
Figure 8:
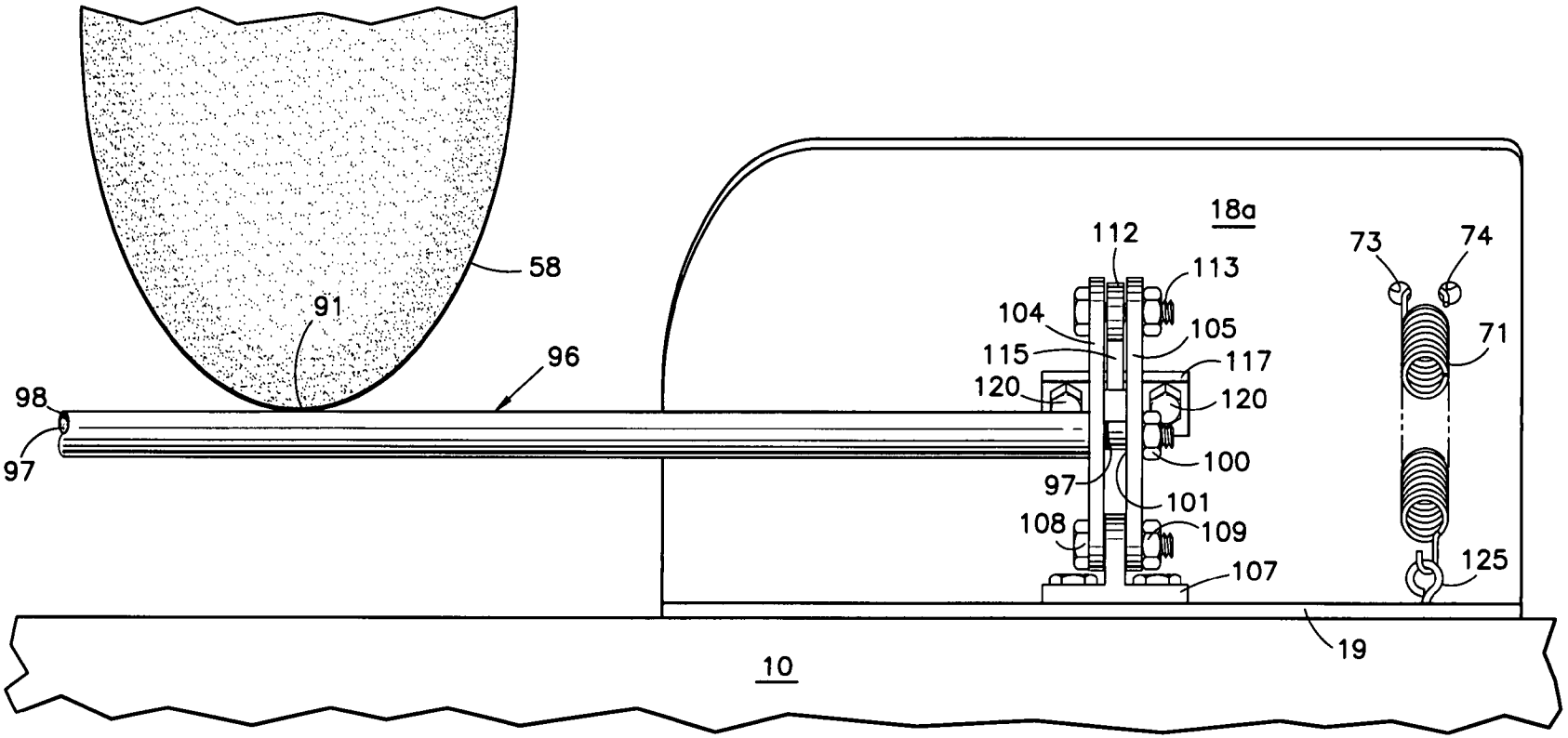
FIG. 8 is a partial top plan view of the embodiment of FIG. 7.

For outboard motors fitted to a transom directly, without a jack plate, and for inboard/outboard drives, a different sort of mechanism may be used. In such a case, two separate trim tabs, one on each side of the engine may be used, using a push bar between the engine drive and the transom to operate the mechanism, the engine not being connected thereto and free to turn in any direction at any trim position. Another embodiment of the invention is illustrated in FIGS. 7 and 8. In FIG. 8, and depicted in solid lines in FIG. 7, a drive of, for instance, an inboard/outboard (outdrive) system is depicted at a pickup point, that is, the point where reducing the trim of the drive will actuate the mechanism to lower the trim tab.

In FIG. 7, the drive is represented at the pickup point by a solid line 91, and is represented at a position where the trim tab 18*a* is completely lowered, by a dash line 92. In FIG. 8, the aftmost tip of the drive 58 is equivalent to the line 91 in FIG. 7. To provide clearance for the drive, which is very close to the transom in an outboard system with no jack plate or in an inboard/outboard system, two separate trim tabs are used, only the port trim tab 18*a* being illustrated in FIGS. 7 and 8.

The mechanism is operated by a push bar 96 which may have an inner steel rod 97 and a hard, lubricating plastic outer tube 98, such as TEFLON® or DELRIN®, or other suitable plastic. The ends of the rod 97 may be secured with a nut 100. A shoulder 101 may be provided to assist in separating a pair of generally L-shaped pieces 104, 105. The pieces 104, 105 are rotatably attached to a tongue 107 by a pintle bolt 108 secured by a nut 109. Between the other ends of the pieces 104, 105 a tongue 112 is rotatably secured by a pintle bolt 113. The tongue 112 is threaded to a rod 115, the other end of which is threaded to a tongue 116 which is rotatably secured to a clevis 117 by a pintle bolt 118. The clevis 117 is secured to the trim tab 18*a* by any suitable means such as a pair of short machine screws 120. The spring 71 (shown only in FIG. 8 for clarity) may be secured to an ordinary eye 125.

Referring to FIG. 7, when the drive 58 is moved from the pickup point denoted by the solid line 91 to its lowermost trim position, denoted by the dash line 92, the pieces 104, 105 will rotate clockwise so that the mechanism and the trim tab assume the positions illustrated by the dotted lines in FIG. 7.

The embodiment of FIGS. 7 and 8 is suited to an inboard/outboard drive which, in its lowest trim position, is very close to the transom. The same mechanism may be used with an outboard motor in the absence of a jack plate, although provision may be made to accommodate the fact that the outboard motor is farther away from the transom, due to the transom bracket 123 (FIG. 1).

The pieces 104, 105 may be provided with several different holes to make it easy to adjust the mechanism for the desired relationship between the trim position of the drive and the position of the trim tabs 18*a*. The trim plate 18*a* is shown in solid lines in a very high position; typically, the proximal part of the trim plate 18*a*, when withdrawn, may be horizontal, or just above horizontal.

In some cases, the embodiment of FIGS. 5 and 6 may be modified in various ways so as to connect the trim tab operating mechanism directly to an outboard motor without a jack plate or directly to an inboard/outboard drive. One way to achieve this is to provide two sets of the embodiment of FIGS. 5 and 6, they however being rotated 90° so as to take up little fore and aft space but instead to be athwartship. Each mechanism will then operate a separate trim tab, such as the trim tab 18*a* in FIG. 8. In such a case, the pieces 33, 34 would likely be straight (similar to the pieces 204, 105 in FIGS. 7 and 8) and disposed to rotate in planes generally parallel to the transom. All of this should be well within the skill of the art in view of the teachings hereinbefore.

Figure 9:
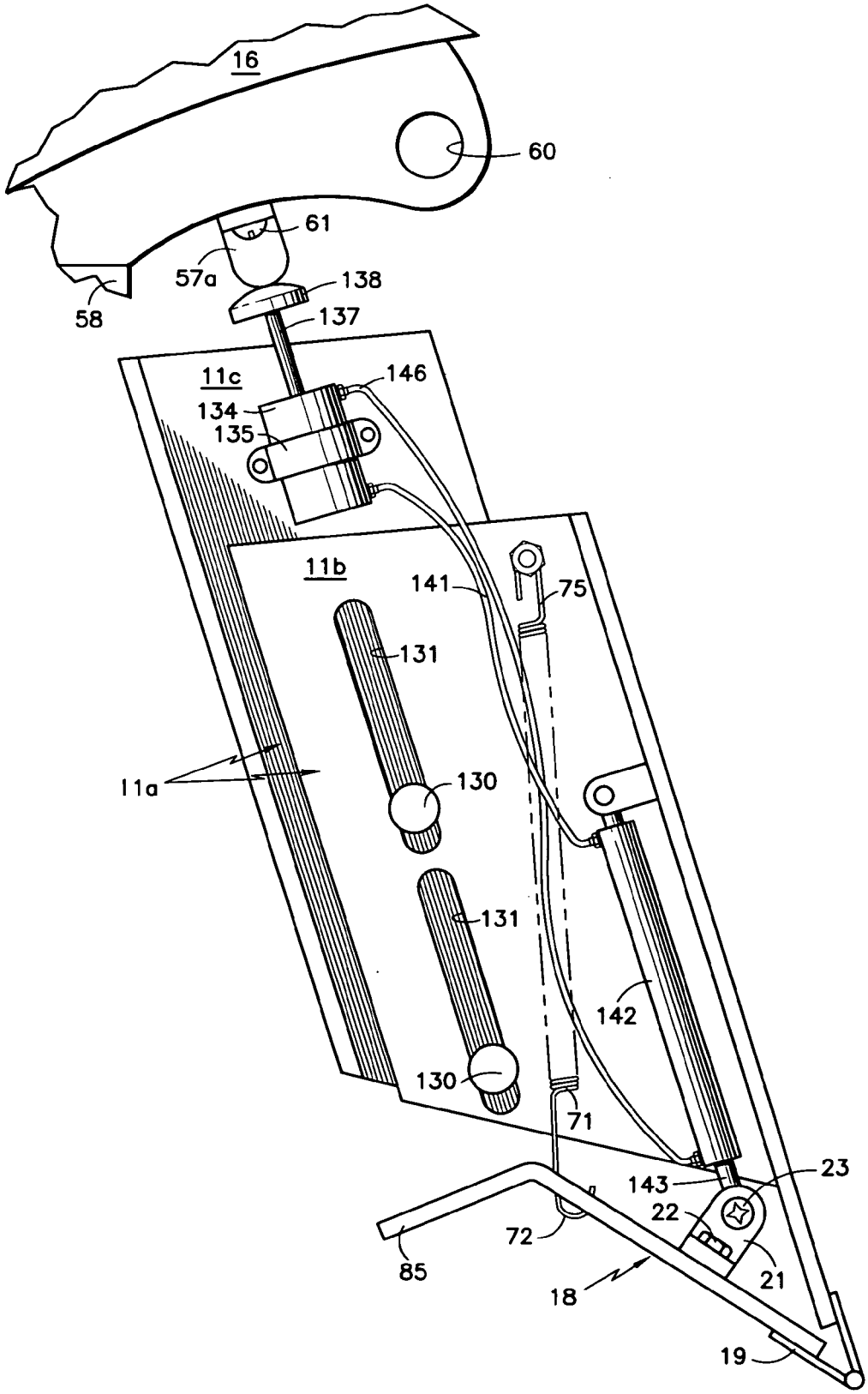
FIG. 9 is a partial, partially sectioned, side elevation view of a passive hydraulic embodiment of the invention.

Referring now to FIG. 9, an adjustable jack plate 11*a* has one portion 11*b* attached to the transom of a boat as described hereinbefore, and another portion 11*c* attached to the motor's transom bracket (123, FIG. 1). Pins 130 on the portion 11*c* slide in slots 131 on the portion 11*b*. The portion 11*c* is shown near its lowest position, and may be raised so as to raise the position of the motor relative to the hull, either manually or by means of hydraulic actuators, all of which is conventional, forms no part of the invention, and is not described further.

In FIG. 9, a master cylinder 134 is anchored to the portion 11*c*, such as by means of a bracket 135. The piston of the master cylinder 134 is connected by a rod 137 to a button 138 that is moveable by a knob 57*a* anchored to the engine drive 58, such as by means of machine screws 61.

The button 138 is shown in a position where the knob 57*a* has just engaged it; any further downward trim of the motor will cause the rod 137 to be pushed into the master cylinder 134 causing fluid to flow in a drive hose 141, thereby causing a slave cylinder 142 to extend its rod 143 downwardly and push the trim tab 18 into an effective position. As the piston within the slave cylinder 142 is lowered, fluid is vented to the master cylinder 134 through a vent hose 146.

When the motor is raised from its lowest trim position, the spring 71 will raise the trim tab and cause the shaft 143 to advance into the slave cylinder 142 forcing fluid through the vent hose 146 and the drive hose 141 so as to restore the cylinders to their inoperative positions as shown in FIG. 9.

As an example, the master cylinder may have an inner diameter of about two inches, the slave cylinder may have an inner diameter of about three-quarter inch, and in such a case, a movement of the rod 137 of about three-quarters of an inch will cause the rod 143 to move about three inches, which is adequate to position the trim tab 18. Of course, variations in the size and stroke of the cylinders can be made to suit any implementation of the present invention. Also, the point where the slave cylinder is attached to the trim tab may be adjusted so as to provide desired performance.

Figure 10:
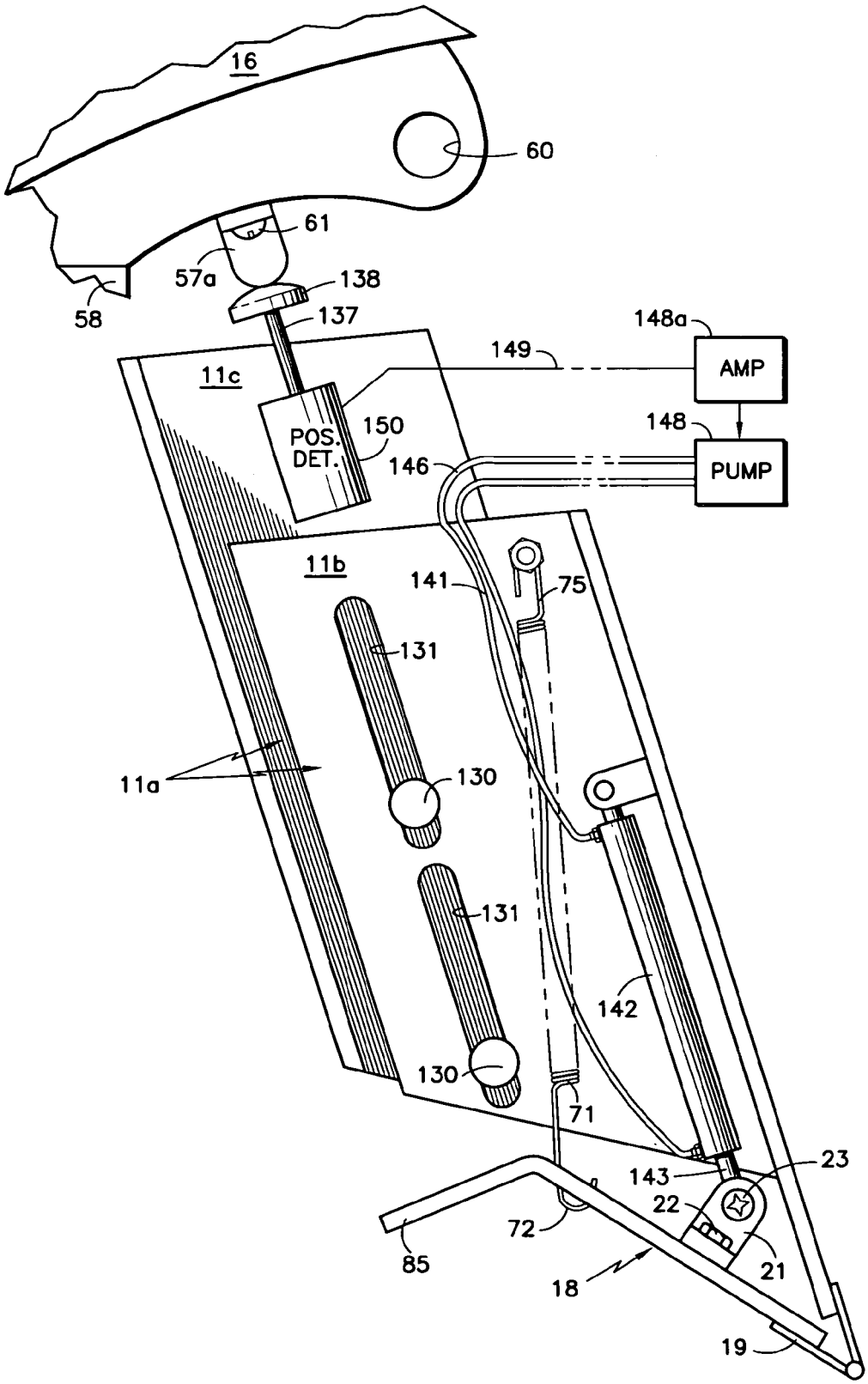
FIG. 10 is a side elevation view of an embodiment of the invention using an electrical position detector to operate a hydraulic actuator.

In FIG. 10, the slave cylinder 142 is driven by a pump 148 on the boat, in response to an amplifier or other electronic signal conditioning 148*a* in response to a position signal on a line 149 provided by a position detector 150. The position detector may take a variety of forms, not relevant to the invention, such as a linear variable differential transformer (LVDT), a suitably geared potentiometer, or other position detectors which are known in the art. This embodiment may be utilized on boats already having hydraulic trim which are operated by manual controls, such as a solid state electronic gauge, a time wheel or other control devices. Thus, a boat already having hydraulic trim tabs need only provide the position detector 150 and the suitable electronics 148*a* in order to take advantage of the present invention.

In FIG. 10, the spring 71 may be eliminated, and the pump 148 utilized to draw the trim plate 18 back into the rest position as shown in FIG. 10.

Figure 11:
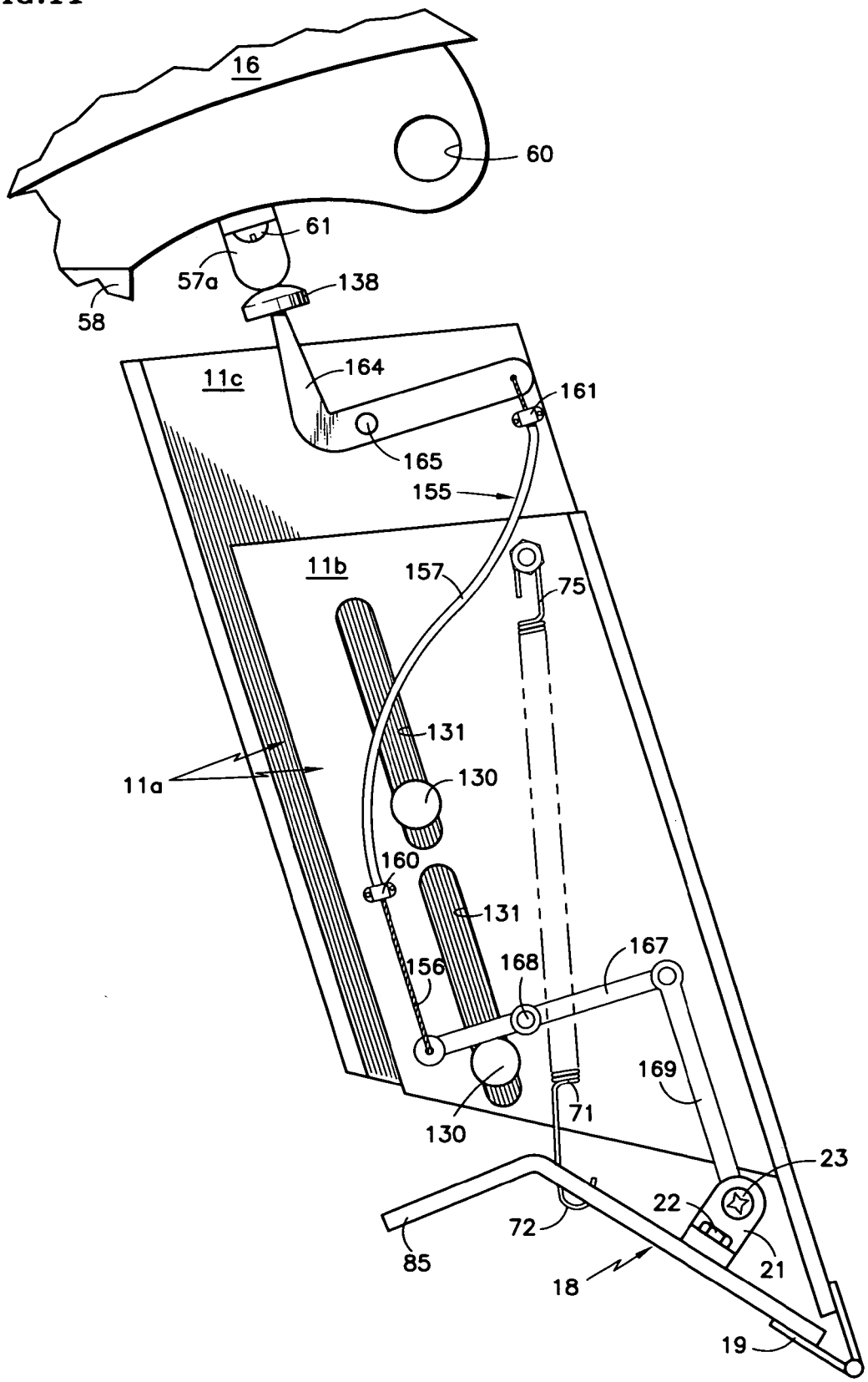
FIG. 11 is a side elevation view of an embodiment of the invention utilizing a force transmitting cable and linkages to cause the trim position of the drive to operate the trim tab.

FIG. 11 illustrates an embodiment of the invention utilizing a force transmitting cable assembly 155 having a rigid flexible cable 156 within a sheath 157 which is secured at one end to the jack plate portion 11*b* by a bracket 160 and is secured at the other end to the jack plate portion 11*c* by a bracket 161. When the motor is trimmed below the contact point shown in FIG. 11, an arm 164 will rotate counterclockwise about a pivot 165 thus drawing the cable 156 upwardly. This will cause an arm 167 to rotate clockwise about a pivot 168 and cause a rod 169 to push downwardly, thus lowering the trim tab 18 into an operative position.

Figure 12:
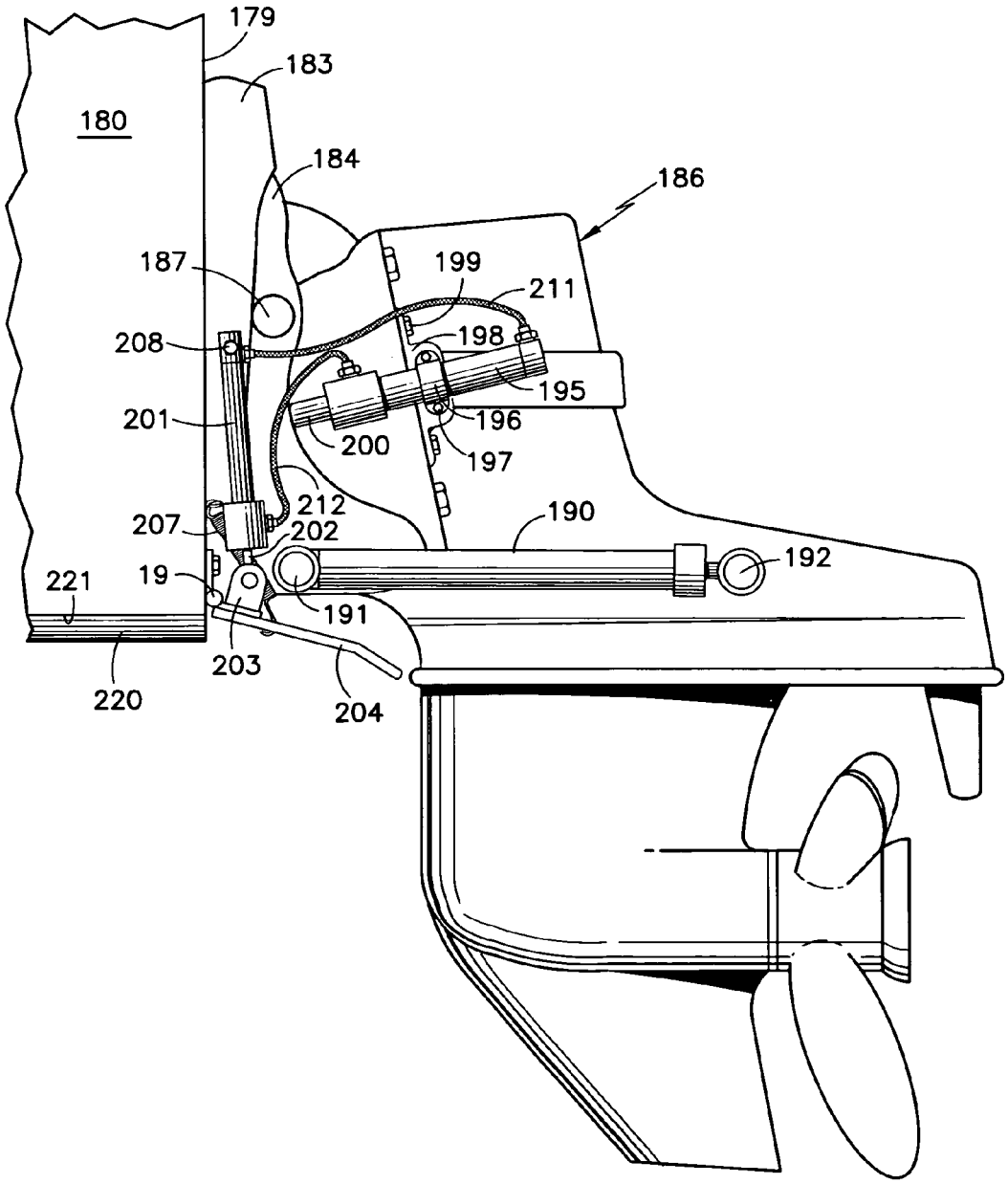
FIG. 12 is a side elevation view of an outdrive installed on a boat hull, with a hydraulic/pneumatic embodiment of the invention installed, when the drive and the trim tab are all the way down.

Referring to FIG. 12, the transom 179 of a boat hull 180 has two parts of an outdrive 183, 184 attached thereto. The outdrive itself 186 is rotatable in trim about a pivot 187 disposed in the non-moving part 184. The outdrive 186 is positioned in trim by means of a pair of hydraulic cylinders, only the hydraulic cylinder 190 on the near side being shown. The hydraulic cylinders 190 are anchored by a pivot 191 on the fixed part 184 and a pivot 192 on the outdrive 186.

In FIG. 12, the outdrive is shown as being rotated into its lowermost trim position. A fluidic master cylinder 195 is adjustably anchored by a clamp member 196 secured by bolts 197 to a bracket 198 which is captured by bolts 199 that secure the rear half of the upper outdrive to the front half thereof. By loosening the bolts 197, the cylinder 195 and its piston rod 200 can be moved fore or aft into a suitable position. As shown, the master cylinder 195 is in a position which causes a slave cylinder 201 to move its piston rod 202 thereby pushing a clevis 203 which is attached to the trim tab 204 downwardly, so that the trim tab is in an operative position as shown in FIG. 12.

The trim tab 204 has a return spring 207 connected either to the fixed part 183 or the transom 179. The slave cylinder 201 is fastened in a swiveling fashion to the fixed part 183 by a bolt 208. Although not shown in FIG. 12 for clarity, a tether may be provided from the trim tab to the fixed part 183 or the transom 179 so as to limit the downward position of the trim tab 204. This will prevent the trim tab 204 from being rotated by the force of water when the boat is backing up with the outdrive in the lowest trim position. The cylinders are interconnected with a drive hose 211 and a vent hose 212.

Figure 13:
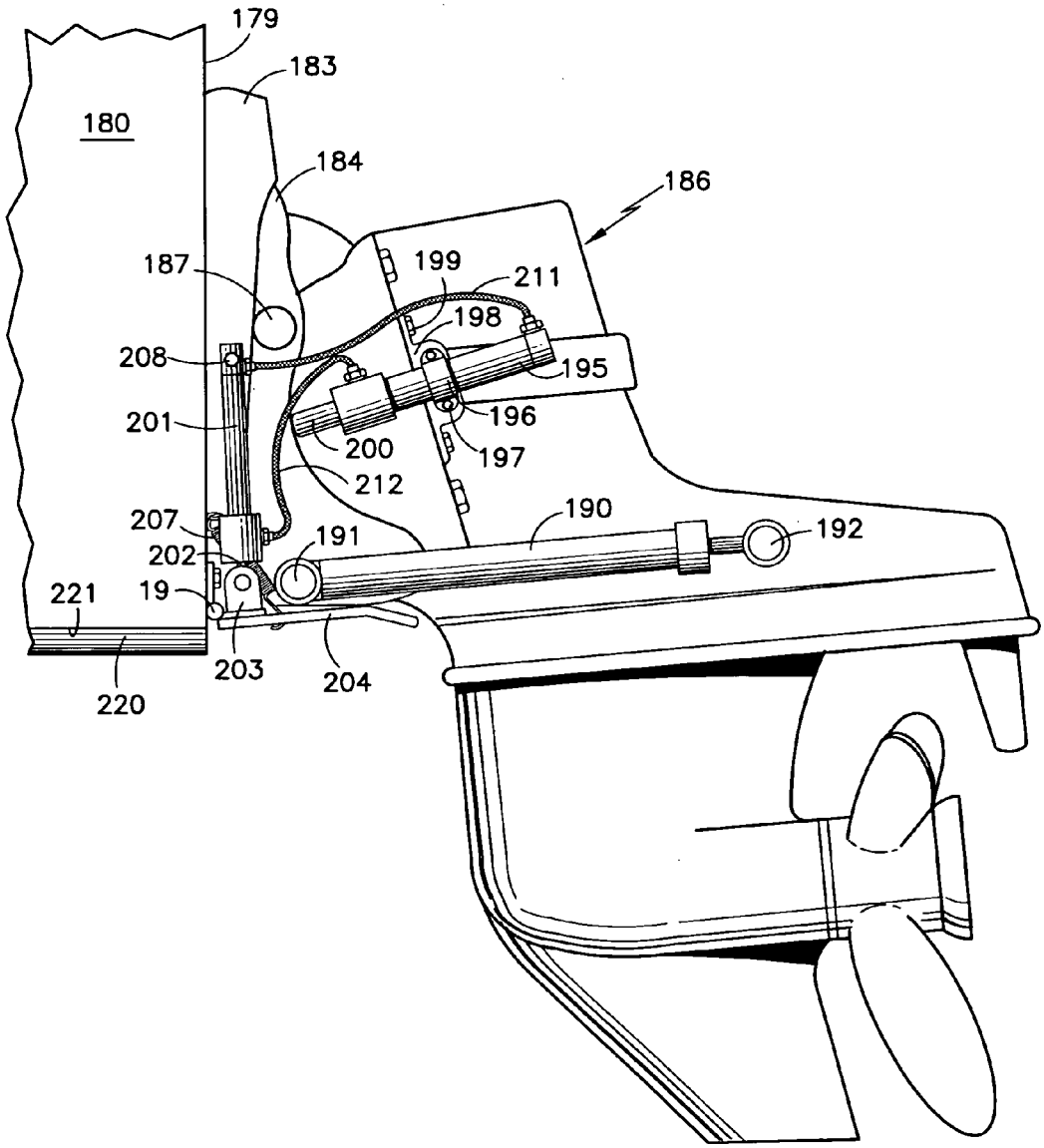
FIG. 13 is a view as in FIG. 1 with the drive partially up, at the pick up point for the trim tab.

In FIG. 13, the outdrive 186 has been trimmed upwardly to the pick up point so that the trim tab 204 is substantially horizontal, slightly above the main hull, out of the way. In FIGS. 12 and 13, a small triangular portion 220 of the hull is shown extending downwardly from the main portion of the hull 180. However, this does not affect the operation of the invention, the trim tabs 204 being hinged at substantially the bottom 221 of the hull. In FIG. 13, any further upward trim (that is, counterclockwise motion of the outdrive 186 about the pivot 187) will not cause any further motion of the piston rod 202. The trim tab 204 may have the shape of trim tab 18, FIG. 6. The piston rods 200, 202 may be protected from the elements by resilient boots.

In each of the embodiments herein, there is lost motion; that is, for trim positions of the drive which are higher than the pick up point, as illustrated in FIGS. 3, 7, 9–11 and 13, there is no motion of the automatic trim device of the invention. In FIG. 7, the lost motion is between the tube 54 and the nut 51. However, it is not necessary that this be so, provided the trim tab assumes a position as illustrated in FIGS. 5, 7, 9–11 and 13 when the drive is trimmed above the pickup point, which is behind the boat and out of the way, and thereafter is not responsive to trim positions of the drive. Any sort of suitable apparatus may operate the trim tab in response to any compatible sort of signal or motion indicative of the position of the drive.

The invention may be used with outboard motors or inboard/outdrive units having a jet drive instead of a propeller.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. An automatic trim system for a power boat having a hull with a transom and a propulsion system including a motor connected to a propeller through a drive, said propeller and drive being adjustable between various trim positions, said system comprising:

at least one trim tab disposed to rotate about a point near a base of the transom of the boat between (a) a position aft of and lower than the bottom of the hull of the boat and (b) a position where the trim tab is substantially out of water and of no adverse effect when the boat is moving above low speed;

first means operable between a first position and a second position and connected to said at least one trim tab so that said at least one trim tab is in said position (a) when said first means is in said first position and is in said position (b) when said first means is in said second position; and second means responsive to the trim position of said drive to position said first means in said first position when said drive is in the lowest trim position and to position said first means in said second position whenever said drive is in a trim position between a selected pickup trim position and the highest trim position.

2. A system according to claim 1 wherein:

said propulsion system is an outboard motor mounted to the transom by a jack plate;

at least portions of said first and second means are disposed within said jack plate; and said second means is connected to said motor aft of a tilt tube thereof.

3. A system according to claim 2 wherein:

said second means includes a push tube; and said first means includes a push rod, a portion of which is within said push tube, and means for causing said push tube to engage said push rod at trim positions of said drive between said pickup trim position and the lowest trim position.

4. A system according to claim 1 wherein:

said second means is a push bar extending horizontally between the drive and the transom and engaged by the drive at said pickup point, said push bar connected to said first means.

5. A system according to claim 1 wherein:

said first means is a slave fluidic cylinder; and said second means is a master fluidic cylinder in fluid communication with said slave fluidic cylinder.

6. A system according to claim 1 wherein:

said first means is a fluidic cylinder; and said second means includes (a) a fluid pump connected to said fluidic cylinder, and (b) a position sensor responsive to the trim position of said propeller and drive to provide a position signal indicative thereof;

said pump providing fluid under pressure in response to said position signal.

7. A system according to claim 1 wherein:

said first and second means include first and second rotatable levers and a force transmitting cable extending between said first and second rotatable levers.

8. A system according to claim 1 wherein said second means is responsive to the trim position of said drive to position said first means in positions between said first position and said second position in response to the trim position of said drive being between said lowest trim position and said selected pickup trim position.

9. A system according to claim 1 wherein:

said propeller is disposed on a portion of an outdrive which is rotatable to adjust trim;

said second means is a fluidic master cylinder disposed on said rotatable portion and having a piston rod which engages said transom or a non-rotatable portion of said outdrive at trim positions at or below said pick up point; and said first means is a fluidic slave cylinder, disposed on a non-rotating portion of said outdrive, in fluid communication with said fluidic master cylinder, and having a cylinder rod attached to said trim tab.

10. A system according to claim 9 wherein:

said cylinders are hydraulic cylinders.

11. A method of operating at least one trim tab on a power boat having a hull with a transom and a propulsion system including a motor connected to a propeller through a drive, said propeller and drive being adjustable between various trim positions independently of any relative motion between the hull and water, said at least one trim tab disposed to rotate about a point near a base of the transom of the boat between (a) a position aft of and lower than the bottom of the hull of the boat and (b) a position where the trim tab is substantially out of water and of no adverse effect when the boat is moving above low speed, said method comprising:

sensing the trim position of said propeller and drive; and positioning said trim tab, without the aid of relative motion between the hull and water, in direct response to the position of said propeller and drive.

12. Apparatus for operating at least one trim tab on a power boat having a hull with a transom and a propulsion system including a motor connected to a propeller through a drive, said propeller and drive being adjustable between various trim positions independently of any relative motion between the hull and water, said at least one trim tab disposed to rotate about a point near a base of the transom of the boat between (a) a position aft of and lower than the bottom of the hull of the boat and (b) a position where the entire trim tab is substantially out of water and of no adverse effect when the boat is moving above low speed, comprising:

first means for sensing the trim position of said propeller and drive; and means responsive to said first means for positioning said trim tab, without the aid of relative motion between the hull and water, in direct response to the position of said propeller and drive.

13. A method of operating at least one trim tab on a power boat having a hull with a transom and a propulsion system including a motor connected to a propeller through a drive, said propeller and drive being adjustable between various trim positions by an operator-controlled power driven trim system, said at least one trim tab disposed to rotate about a point near a base of the transom of the boat between (a) a position aft of and lower than the bottom of the hull of the boat and (b) a position where the trim tab is substantially out of water and of no adverse effect when the boat is moving above low speed, said method comprising:

sensing the trim position of said propeller and drive established by said operator-controlled power driven trim system; and positioning said trim tab in direct response to the trim position of said propeller and drive established by said operator-controlled power driven trim system.

14. Apparatus for operating at least one trim tab on a power boat having a hull with a transom and a propulsion system including a motor connected to a propeller through a drive, said at least one trim tab disposed to rotate about a point near a base of the transom of the boat between (a) a position aft of and lower than the bottom of the hull of the boat and (b) a position where the entire trim tab is substantially out of water and of no adverse effect when the boat is moving above low speed, comprising:

an operator-controlled power driven trim system for adjusting said propeller and drive between various trim positions;

first means for sensing the trim position of said propeller and drive established by said operator-controlled power driven trim system; and means responsive to said first means for positioning said trim tab in direct response to the trim position of said propeller and drive established by said operator-controlled power driven trim system.

15. A method of operating at least one trim tab on a power boat having a hull with a transom and a propulsion system including a motor connected to a propeller through a drive, said propeller and drive being adjustable between various trim positions from a lowest trim position through a selected pickup trim position distant from said lowest trim position, to a highest trim position distant from said selected pickup trim position, said at least one trim tab disposed to rotate about a point near a base of the transom of the boat between (a) a position aft of and lower than the bottom of the hull of the boat and (b) a position where the trim tab is substantially out of water and of no adverse effect when the boat is moving above low speed, said method comprising:

sensing the trim position of said propeller and drive; and positioning said trim tab in said position (a) in response to the sensed position of said propeller and drive being said lowest trim position and for positioning said trim tab in said position (b) in response to the sensed position of said propeller and drive being between said selected pickup trim position and said highest trim position.

16. Apparatus for operating at least one trim tab on a power boat having a hull with a transom and a propulsion system including a motor connected to a propeller through a drive, said propeller and drive being adjustable between various trim positions from a lowest trim position through a selected pickup trim position distant from said lowest trim position, to a highest trim position distant from said selected pickup trim position, said at least one trim tab disposed to rotate about a point near a base of the transom of the boat between (a) a position aft of and lower than the bottom of the hull of the boat and (b) a position where the entire trim tab is substantially out of water and of no adverse effect when the boat is moving above low speed, comprising:

first means for sensing the trim position of said propeller and drive; and means responsive to said first means for positioning said trim tab in said position (a) in response to the sensed position of said propeller and drive being the lowest trim position and for positioning said trim tab in said position (b) in response to the sensed position of said propeller and drive being between a selected pickup trim position and the highest trim position.

* * * * *